US009372446B2

(12) United States Patent
Nishikawa

(10) Patent No.: US 9,372,446 B2
(45) Date of Patent: Jun. 21, 2016

(54) IMAGE FORMING APPARATUS

(71) Applicant: CANON KABUSHIKI KAISHA, Tokyo (JP)

(72) Inventor: Akihiro Nishikawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/932,312

(22) Filed: Nov. 4, 2015

(65) Prior Publication Data

US 2016/0124355 A1 May 5, 2016

(30) Foreign Application Priority Data

Nov. 5, 2014 (JP) ..... 2014-225644

(51) Int. Cl.
*G03G 15/16* (2006.01)

(52) U.S. Cl.
CPC ..... *G03G 15/1665* (2013.01)

(58) Field of Classification Search
CPC ..... G03G 15/1605; G03G 15/1675; G03G 15/1665
See application file for complete search history.

(56) References Cited

U.S. PATENT DOCUMENTS

2013/0195519 A1 8/2013 Ito et al.

FOREIGN PATENT DOCUMENTS

| | | | |
|---|---|---|---|
| JP | 10-142953 | A | 5/1998 |
| JP | 2006-259640 | A | 9/2006 |
| JP | 2012-137733 | A | 7/2012 |
| JP | 2013-213990 | A | 10/2013 |
| JP | 2014-106444 | A | 6/2014 |

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes a photosensitive drum; a charger; an intermediary transfer belt; a transfer member; a constant voltage element; a switch for selectively providing a first state using the constant voltage element and a second state not using the constant voltage element; a voltage source for applying a current to the constant voltage element by applying a voltage of a second polarity opposite the first polarity to the transfer member to form a secondary electric field in the secondary-transfer position and a primary electric field in the primary transfer position; and a controller for executing an adjustment applying the second polarity voltage to the transfer member when neither the primary-transfer operation nor the secondary-transfer is carried out, wherein the controller provides the second state using the switching portion in a period in which the second polarity voltage is applied to the transfer member.

5 Claims, 11 Drawing Sheets

IMAGE FORMING APPARATUS

FIELD OF THE INVENTION AND RELATED ART

The present invention relates to an image forming apparatus such as an electrophotographic copying machine, a laser printer, and the like.

There have been electrophotographic image forming apparatuses of the so-called intermediary transfer type, which form a toner image on their photosensitive component, transfer (primary transfer) the toner image onto their intermediary transfer component, and then, transfer (secondary transfer) the toner image onto a sheet of transfer medium such as paper. Some of them have multiple image forming sections which are different in the color of the monochromatic toner image they form. They sequentially transfer (primary transfer) multiple monochromatic toner images, different in color, onto the intermediary transfer component, from the image forming sections, and then, transfer together (secondary transfer) the multiple monochromatic toner images onto a sheet of transfer medium from the intermediary transfer component. They are referred to as an electrophotographic image forming apparatus of the tandem type. Generally speaking, a photosensitive drum is used as the photosensitive component. As the intermediary transfer component, an endless belt (intermediary transfer belt) is used.

In each of the image forming sections of an electrophotographic image forming apparatus of the tandem type, which employs an intermediary transfer component, the peripheral surface of the rotating photosensitive drum is uniformly charged to preset polarity and potential level, and then, is exposed to form an electrostatic latent image on the peripheral surface of the photosensitive drum. Then, toner is supplied to the electrostatic latent image on the peripheral surface of the photosensitive drum, developing thereby the latent image into a visible image, that is, an image formed toner (hence, toner image). After the formation of the toner image on the peripheral surface of the photosensitive drum, the toner image is transferred (primary transfer) onto the intermediary transfer belt by a primary transfer component disposed in such a manner that it opposes photosensitive drum with the presence of intermediary transfer belt between itself and photosensitive drum. Generally, a roller (primary transfer roller) is used as the primary transfer component. The primary transfer roller is pressed against the photosensitive drum with the presence of the intermediary transfer belt between itself and photosensitive drum. The primary transfer roller in each of the image forming sections is in connection to an electric power source (high voltage power source) dedicated to primary transfer. To the primary transfer roller, preset primary transfer voltage is applied from this power source dedicated to the primary transfer.

After the transfer of the toner images onto the intermediary transfer belt, the toner images are transferred (secondary transfer) onto a sheet of transfer medium from the intermediary transfer belt, by a secondary transfer component disposed in contact with the intermediary transfer belt. Generally, a roller (secondary transfer roller) is used as the secondary transfer. The secondary transfer roller is pressed against one of the rollers by which the intermediary transfer belt is suspended and kept tensioned, with the presence of the intermediary transfer belt between itself and the corresponding belt supporting-tensioning roller. The secondary transfer roller is in connection to an electric power source (high voltage power source) dedicated to secondary transfer. To the secondary transfer roller, preset transfer voltage is applied from this power source.

In an image forming apparatus such as the above-described one, a primary transfer process of transferring a toner image from a photosensitive drum onto the intermediary transfer belt simultaneously occurs in the multiple image forming sections. Therefore, it is necessary for each primary transfer roller to be provided with its own primary transfer power source. That is, the image forming apparatus has to be provided with multiple power sources, which in turn increases the apparatus in cost and size. Further, in the primary transferring section, the toner particles, of which the toner image is formed, are subjected by the primary transfer roller, to the pressure generated between the intermediary transfer belt and the peripheral surface of the photosensitive drum. Thus, some toner particles in the toner image cohere, and fail to be transferred from the photosensitive drum onto the intermediary transfer belt, in the primary transferring section, and/or from the intermediary transfer belt onto recording medium, in the secondary transferring section, causing thereby an image forming apparatus to output images, a part or parts of which are missing.

Thus, there have been proposed various means to deal with the above-described issue. One of the means is disclosed in Japanese Laid-open Patent Application No. 2006-259640. According to this application, the image forming apparatus is not provided with the primary transfer rollers, in order to eliminate the problem that the toner particles in a toner image are made to cohere in the primary transferring section, by the pressure applied by the primary transfer roller.

Further, it is disclosed in Japanese Laid-open Patent Application No. 2012-137733, to make electric current flow through the intermediary transfer belt in the circumferential direction of the belt, from the secondary transferring section, not only to transfer (primary transfer) a toner image from a photosensitive drum onto the intermediary transfer belt, but also, to transfer (secondary transfer) the toner image from the intermediary transfer belt onto transfer medium. In this case, an electrically conductive endless belt, which allows electric current to flow through itself in its circumferential direction, is employed as the intermediary transfer belt. Further, the rollers by which this endless belt is suspended and kept tensioned are grounded through a passive element such as a resistor, a varistor, and a Zener diode, and voltage is applied to the secondary transfer component to flow electric current through the belt.

That is, by grounding all the belt-suspending-tensioning rollers through the abovementioned passive element, it is possible to prevent the primary transfer current from wastefully flowing through the rollers. Further, by employing an endless belt having at least a low resistance layer as the intermediary transfer belt, it is possible to cause the high voltage applied to the secondary transfer roller, to act on the primary transferring section through the intermediary transfer belt. For example, in a case where all the belt-suspending-tensioning rollers are grounded through electrically resistive element(s), the potential of the intermediary transfer belt can be kept at a desired level, which can be controlled by controlling the voltage to be applied to the secondary transfer roller. Further, as voltage is applied to the secondary transfer roller, electrical current flows into the photosensitive drum in each image forming section through the intermediary transfer belt. That is, a combination of the intermediary transfer belt and the power supply for the secondary transfer provides the same function as the primary transferring section in a conventional electrophotographic image forming apparatus.

However, it was found that an electrophotographic image forming apparatus such as the above described one which is not provided with an electric power source dedicated to the primary transfer, suffers from the following problem, when an adjustment operation which is to be carried out by a conventional electrophotographic image forming apparatus, that is, an image forming apparatus provided with an electric power source dedicated to the primary transfer, is carried out by this image forming apparatus.

That is, one of the adjustment operations carried out by a conventional electrophotographic image forming apparatus during one of the periods in which no image is formed is an ATVC (Active Transfer Voltage Control) which is for determining the proper amount by which voltage is to be applied to the secondary transfer roller during the secondary transfer period. In the secondary transfer ATVC, various voltages which are different in magnitude are applied to the secondary transfer roller to obtain the relationship between the value of the applied voltage and the value of the current flowed by the applied voltage. Then, the proper value for the voltage to be applied to the secondary transfer roller during the secondary transfer period is determined based on the relationship.

In the case of a conventional electrophotographic image forming apparatus, that is, an electrophotographic image forming apparatus having both an electric power source dedicated to the primary transfer and an electric power source dedicated to the secondary transfer, voltage is applied to the secondary transfer roller to flow electric current to a grounded roller, which is one of the rollers by which the intermediary transfer belt is suspended and kept tensioned. Therefore, the voltage applied to the secondary transfer roller has no effect upon the primary transferring section. That is, it can be thought that the secondary transfer ATVC is independent from the primary transferring section. Thus, it is unnecessary to synchronize the voltage application to the secondary transfer roller, with the application of charge voltage to charge a photosensitive drum, when executing the secondary transfer ATVC.

In comparison, in the case of an electrophotographic image forming apparatus which is not provided with the above described electric power source dedicated to the primary transfer, the surface potential level of the intermediary transfer belt in the primary transferring section is set by intentionally causing the secondary transfer voltage to interfere with the primary transferring section. Thus, it is unavoidable that as the secondary transfer voltage is applied, the voltage is also applied to the primary transferring section.

However, as voltage is applied to the primary transferring section during a period in which an area of the peripheral surface of a photosensitive drum, which is yet to be charged, is being moved through the primary transferring section, it sometimes occurs that this area of the peripheral surface of the photosensitive drum is charged to the opposite polarity from the normal polarity to which it is to be charged. Thus, as the peripheral surface of the photosensitive drum is charged thereafter for image formation, the peripheral surface of the photosensitive drum becomes nonuniformly charged (which hereafter may be referred to as "drum memory"), making it possible that image defects such as nonuniformity in image density will occur. Once drum memory occurs to a photosensitive drum, this photosensitive drum may have to be replaced. Replacing a photosensitive drum is problematic in that it increases the image forming apparatus in downtime (length of time images cannot be outputted), operational cost, etc.

By the way, in the foregoing, a case in which the adjustment operation was the secondary transfer ATVC was described. However, a problem similar to the above described one will possibly occur in a case where such voltage that is opposite in polarity to the potential to which a photosensitive drum is to be charged is applied to the secondary transfer roller during a period in which no image is formed.

Thus, the primary object of the present invention is to provide an electrophotographic image forming apparatus which is structured to cause electric current to flow to the photosensitive component, for primary transfer, through the intermediary transfer belt, by the application of the secondary transfer voltage, and yet, can prevent the photosensitive component from becoming nonuniformly charged by the effect of the voltage applied to the secondary transferring section during the adjustment operation.

SUMMARY OF THE INVENTION

According to an aspect of the present invention, there is provided an image forming apparatus comprising a photosensitive member configured to carry a toner image; a charging member configured to charge said photosensitive member to a first polarity; an intermediary transfer belt configured to carry the toner image transferred from said photosensitive member at a primary transfer position; a transfer member provided so as to be contactable to an outer peripheral surface of said intermediary transfer belt and configured to transfer the toner image from said intermediary transfer belt onto a recording material at a secondary-transfer position; a constant voltage element electrically connected between said intermediary transfer belt and a ground potential and configured to maintain a predetermined voltage when a current flows therethrough; a switching portion for selectively providing a first state in which said intermediary transfer belt is grounded through said constant voltage element and a second state in which said intermediary transfer belt is grounded not through said constant voltage element; a voltage source configured to apply a current to said constant voltage element by applying a voltage of a second polarity opposite the first polarity to said transfer member to form a secondary-transfer electric field in the secondary-transfer position and a primary transferring electric field in the primary transfer position; and a controller configured to execute an adjusting operation for applying at least the voltage of the second polarity to said transfer member from said voltage source when neither the primary-transfer operation nor the secondary-transfer is carried out, wherein said controller provides the second state using said switching portion in a non-image formation period in which the voltage of the second polarity is applied to the transfer member.

Further features of the present invention will become apparent from the following description of exemplary embodiments (with reference to the attached drawings).

Figure 3:
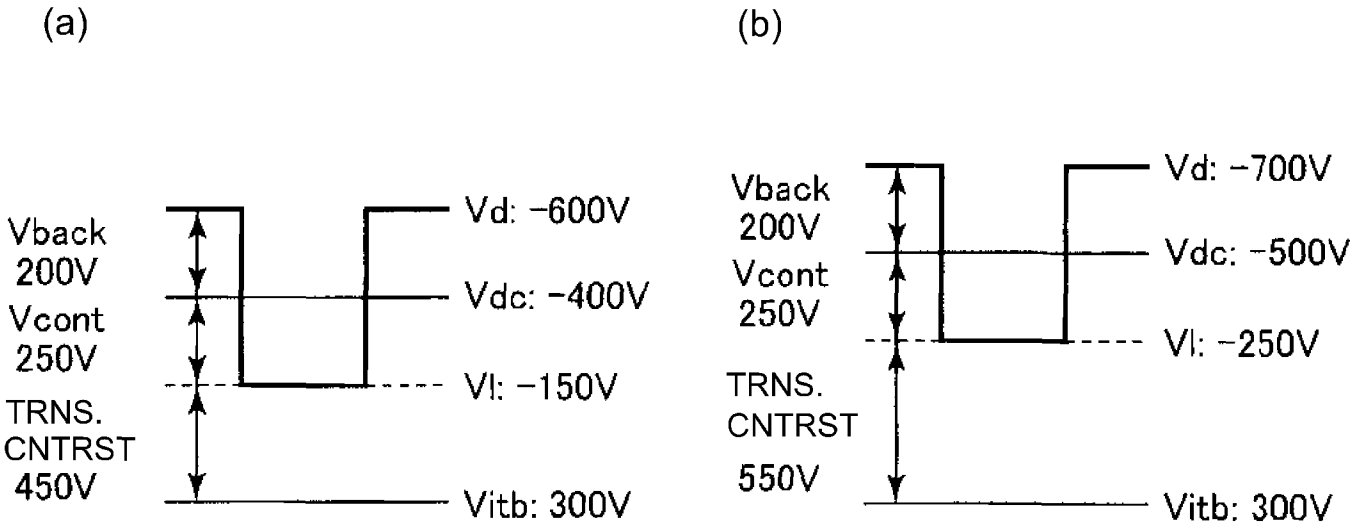

Parts (a) and (b) of FIG. 3 show the method for adjusting the image forming apparatus in transfer contrast.

Figure 4:
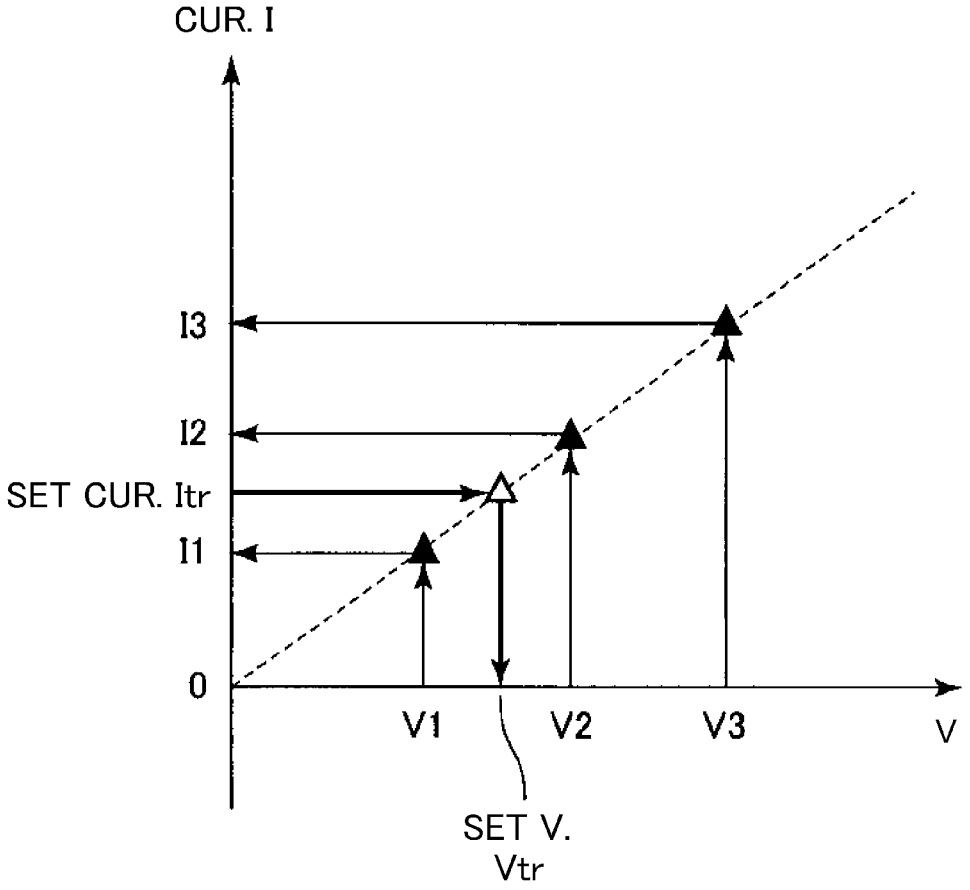

FIG. 4 is a graph for describing the ATVC of the secondary transferring section.

Figure 5:
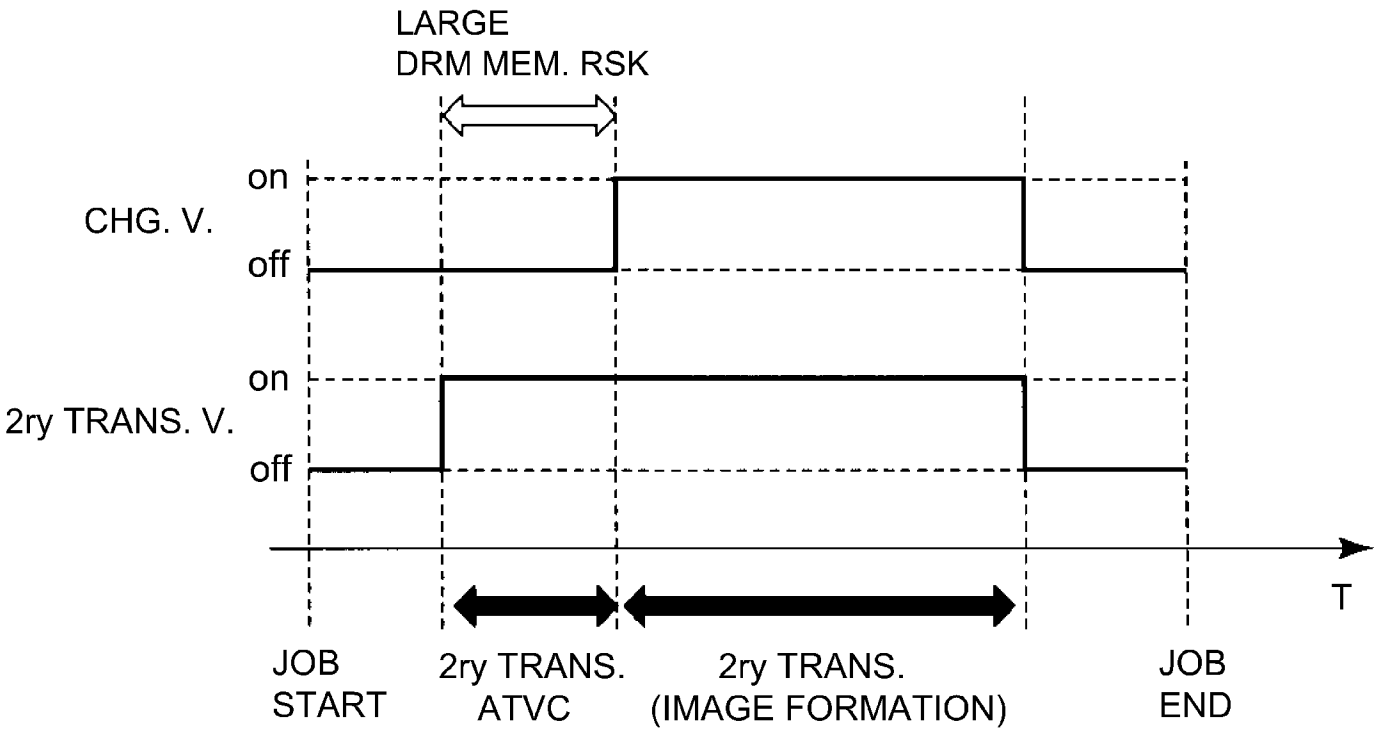

FIG. 5 is a timing chart for the ATVC for the secondary transferring section, for a conventional electrophotographic image forming apparatus.

Figure 6:
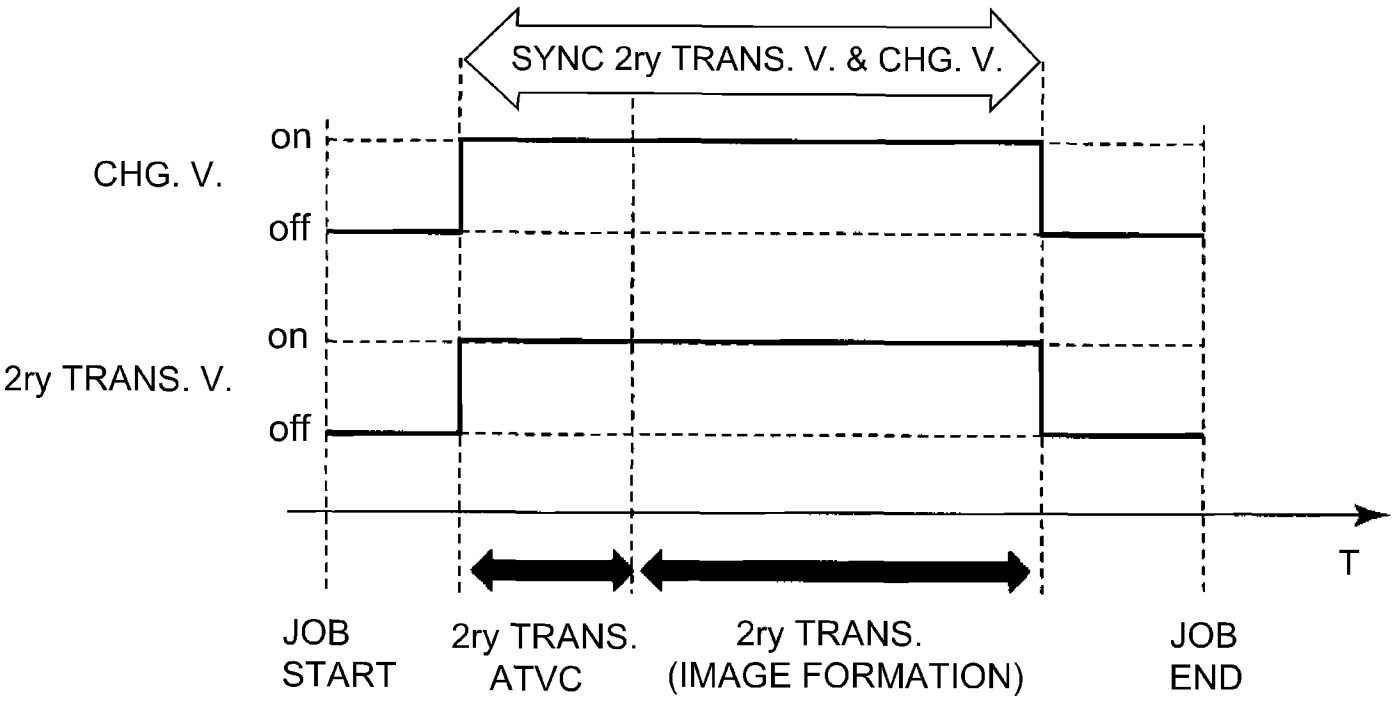

FIG. 6 is a timing chart for the ATVC for the secondary transferring section, in a referential embodiment of the present invention.

Figure 7:
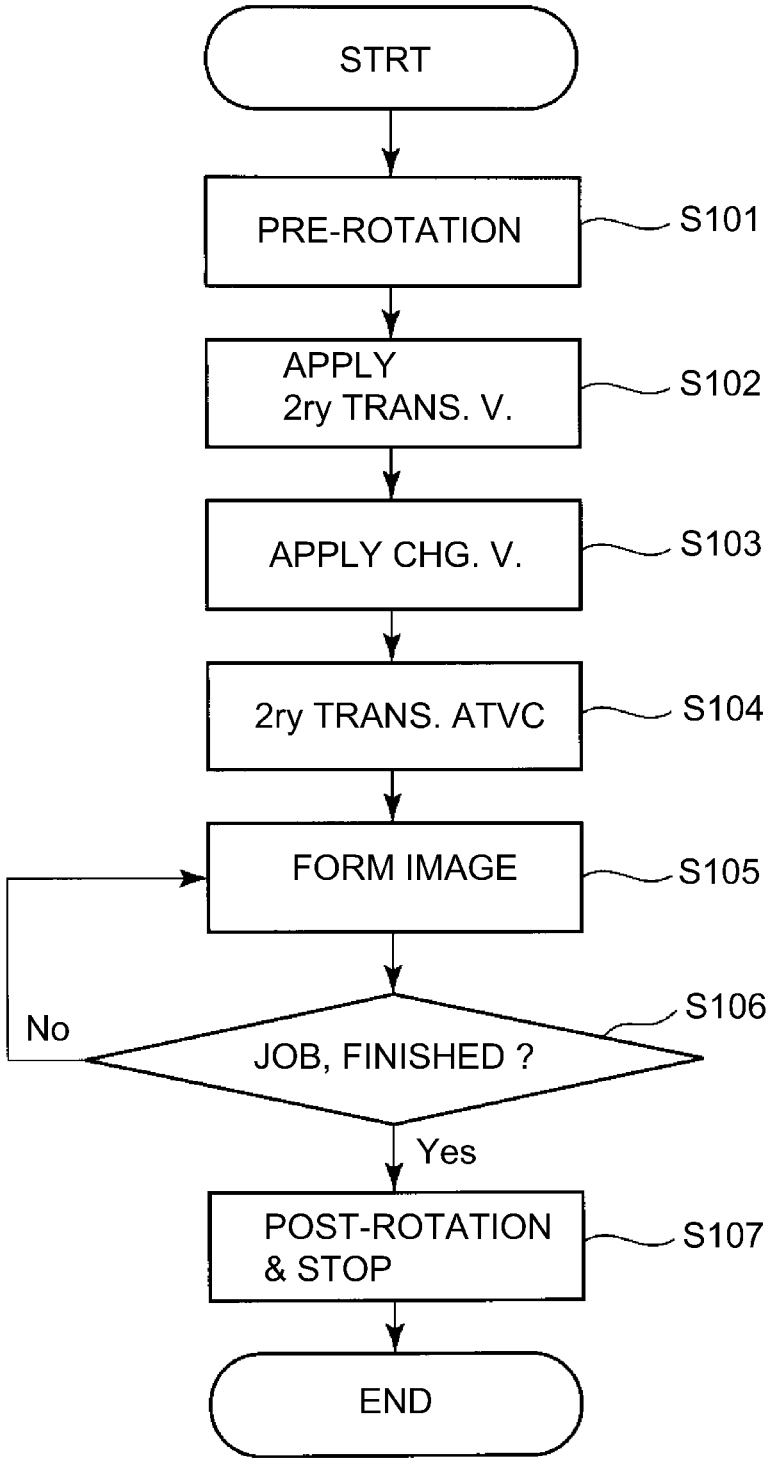

FIG. 7 is a flowchart of the image forming operation of the image forming apparatus in the referential embodiment.

Figure 8:
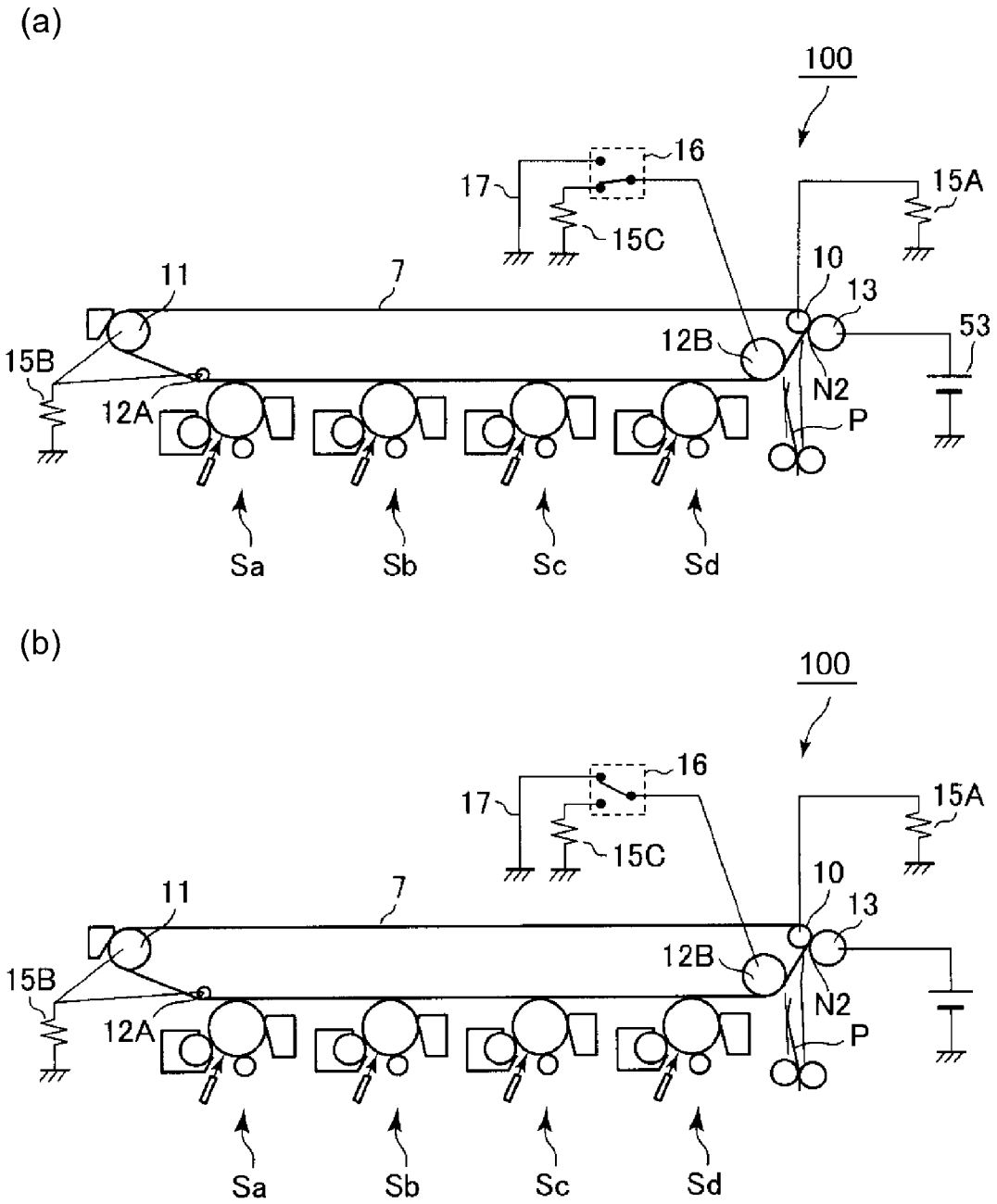

Parts (a) and (b) of FIG. 8 are schematic sectional views of the image forming apparatus in another embodiment of the present invention, and shows the structure of the apparatus.

Figure 9:
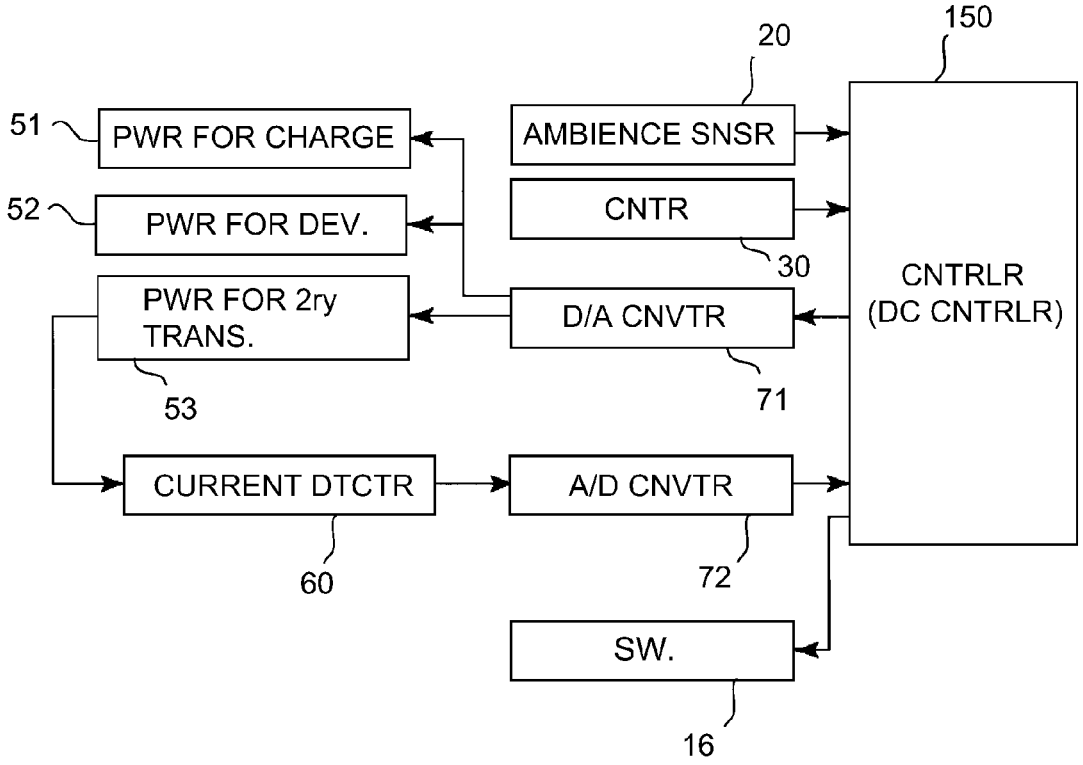

FIG. 9 is a block diagram of the control system of the image forming apparatus, in the first embodiment of the present invention, which is for controlling the essential sections of the apparatus.

Figure 10:
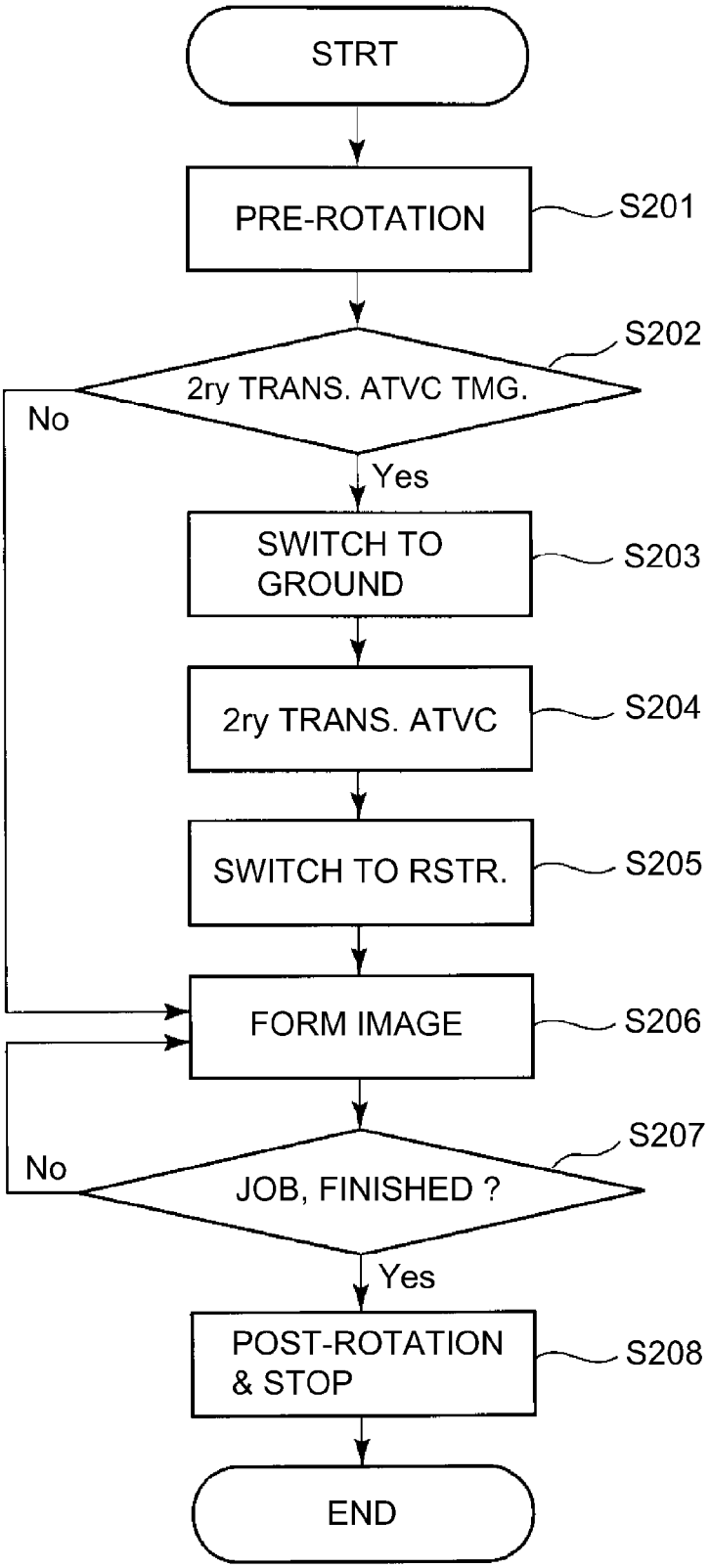

FIG. 10 is a flowchart of the image forming operation of the image forming apparatus in the second embodiment.

Figure 11:
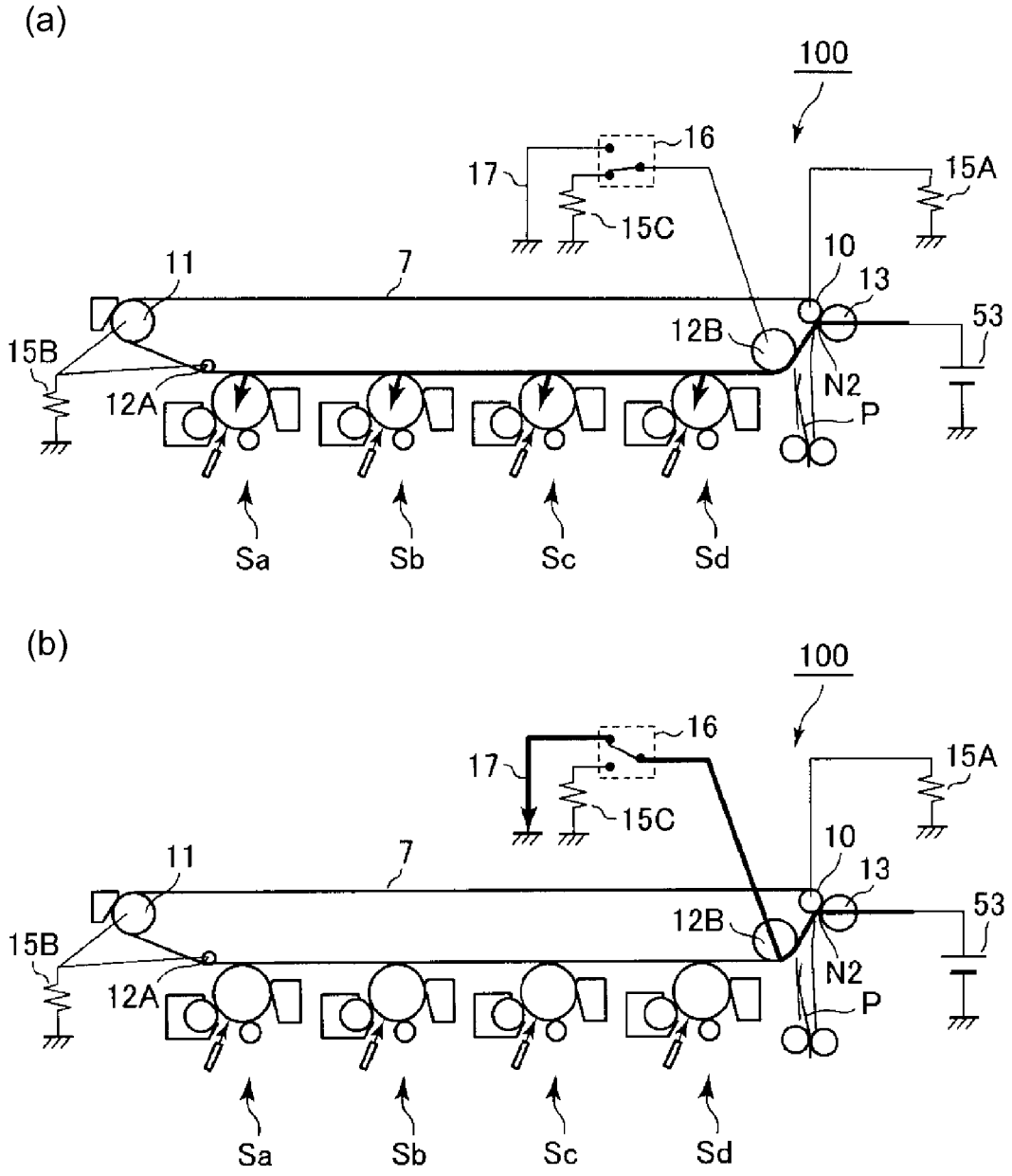

Parts (a) and (b) of FIG. 11 are schematic views showing the electric current paths in the image forming apparatus in the first embodiment.

Figure 12:
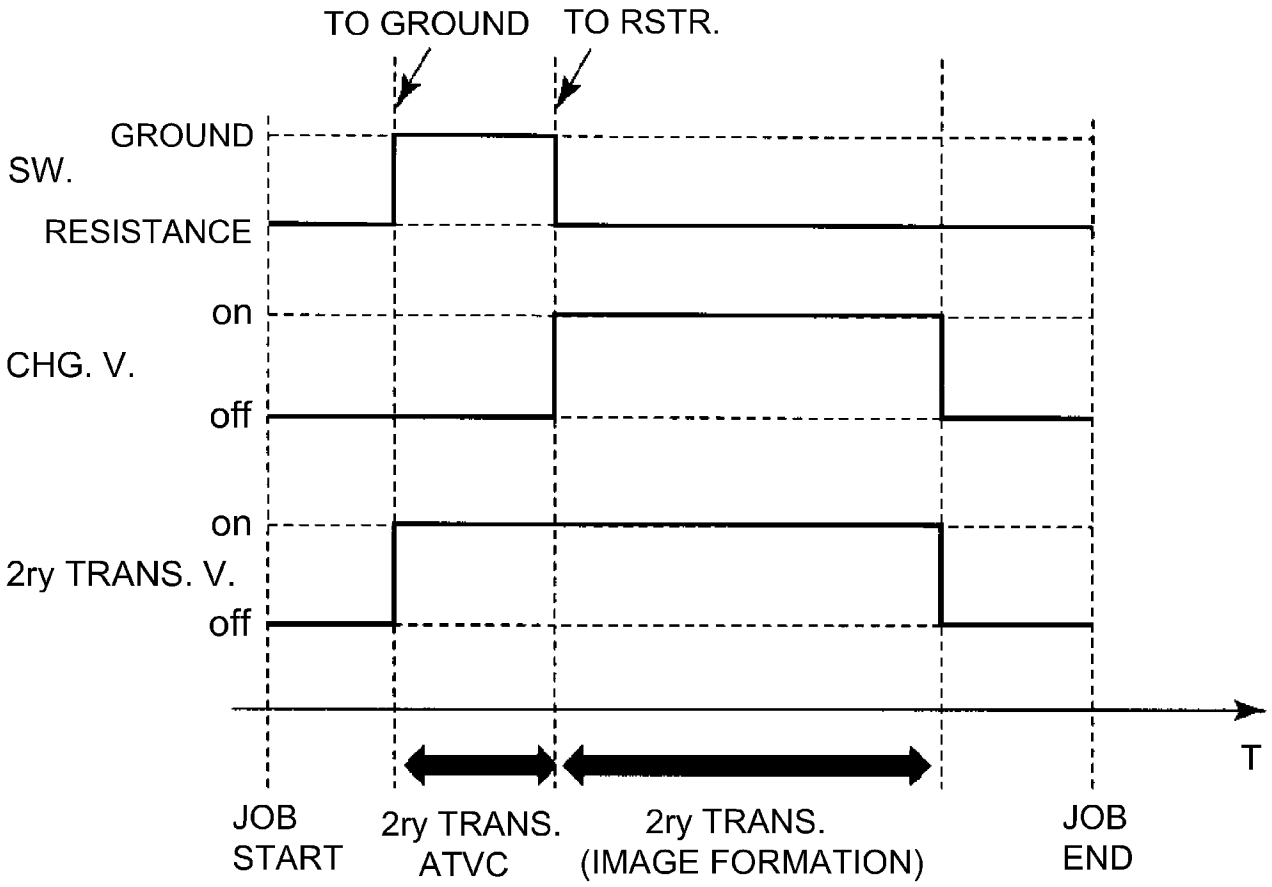

FIG. 12 is a timing chart for the ATVC for the second transfer section, in the first embodiment.

DESCRIPTION OF THE EMBODIMENTS

Hereinafter, image forming apparatuses in accordance with the present invention are described in detail with reference to appended drawings.

Referential Embodiment

1. Overall Structure and Operation of Image Forming Apparatus

Figure 1:
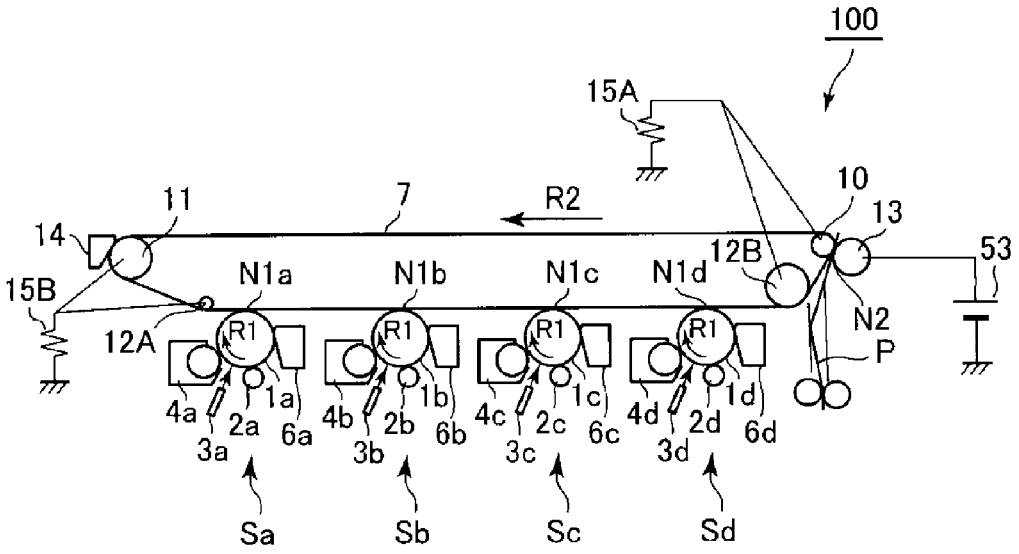
FIG. 1 is a schematic sectional view of a typical electrophotographic image forming apparatus to which the present invention is applicable, and shows the general structure of the apparatus.

FIG. 1 is a schematic sectional view of the image forming apparatus 100 in a referential embodiment of the present invention. It shows the general structure of the image forming apparatus 100. The image forming apparatus 100 in this embodiment is of the so-called tandem type. It uses an electrophotographic image formation method. It is capable of outputting full-color images. More concretely, it is a laser printer capable of outputting full-color images.

The image forming apparatus 100 has multiple image forming sections, more specifically, the first, second, third, and fourth image forming sections (stations) Sa, Sb, Sc and Sd, which form yellow (Y), magenta (M), cyan (C) and black (Bk) monochromatic images, respectively. These image forming sections are aligned with the placement of a preset amount of gap between the adjacent two sections. In this embodiment, the four image forming sections Sa, Sb, Sc and Sd are practically the same in structure and operation, although they are different in the color of the toner they use. Hereafter, therefore, the suffixes of the referential codes, which are for indicating the color with which a given section, components thereof, etc., of the image forming apparatus, are associated, are not shown unless it is required for specific reasons, so that the four image forming sections can be described together.

The image forming section S has a photosensitive drum 1, as an image bearing component, which is an electrophotographic photosensitive component (photosensitive component), which is in the form of a rotatable drum. In this embodiment, the photosensitive drum 1 is an organic photosensitive component, and is negatively chargeable. It is made up of a piece of aluminum cylinder (drum) as a substrate, and a photosensitive layer formed on the peripheral surface of the substrate. It is 30 mm in external diameter. The photosensitive drum 1 is rotationally driven by an unshown driving means in the direction indicated by an arrow mark R1 in the drawing, at a preset peripheral velocity (process speed).

As the photosensitive drum 1 is rotated, its peripheral surface is uniformly charged to preset polarity (negative in this embodiment) and potential level, by a charge roller 2 as a charging means which is a charging component. During this process of charging the photosensitive drum 1, preset charge voltage (charge bias) is applied to the charge roller 2 from a charge voltage power source 51 (high voltage power source) (FIG. 2) as a charge voltage applying means. In this embodiment, the charge voltage power source 51 has a DC outputting section and an AC outputting section. It applies to the charge roller 2 oscillatory voltage, as the charge voltage, which is a combination of DC voltage and AC voltage. The charge roller 2 is kept pressed upon the peripheral surface of the photosensitive drum 1 with the application of a preset amount of pressure.

The charged portion of the peripheral surface of the photosensitive drum 1 is exposed by an exposing device 3 (laser scanner) as an exposing means, in accordance with the information of the image to be formed. The exposing device 3 outputs a beam of laser light while modulating the beam with sequential digital picture element signals which is in accordance with the information of the image to be formed, and which are inputted from a host computer (unshown). The outputted beam of laser light is guided by a mirror, etc., in a manner to scan (expose) the peripheral surface of the photosensitive drum 1. Thus, an electrostatic latent image (electrostatic image), which reflects the information of the monochromatic image, which corresponds to the color component of the image to be formed, to which each image forming section S is associated, is effected on the peripheral surface of the photosensitive drum 1.

After the formation of the electrostatic latent image on the peripheral surface of the photosensitive drum 1, the latent image is developed (into visible image) by the developing device 4 as a developing means, which uses toner as developer. As a result, a visible image (which hereafter will be referred to as toner image) is formed on the peripheral surface of the photosensitive drum 1 in each image forming section S. The color of the toner image formed in each image forming section S corresponds to the specific color component of the image to be formed, to which each image forming section S is associated. The developing device 4 has a housing in which toner is stored, and a development roller as a developer bearing rotatable component disposed at the opening of the housing in a manner to oppose the photosensitive drum 1. During development, preset development voltage is applied to the development roller from a development voltage power source 52 (high voltage power source) (FIG. 2) as a development voltage applying means. In this embodiment, a toner image is formed by a combination of the process of exposing the image forming area of the peripheral surface of the photosensitive drum 1 and the process of reversely developing the exposed area. That is, the developing device 4 adheres toner charged to the same polarity as the peripheral surface of the photosensitive drum 1, to the exposed points of the uniformly charged area of the peripheral surface of the photosensitive drum 1, which was reduced in the absolute value of its potential by the exposure. In this embodiment, during the development, toner is negative (normal) in polarity.

After the formation of a toner image on the peripheral surface of the photosensitive drum 1, the toner image is transferred (primary transfer) onto a intermediary transfer belt 7, which is a circularly movable intermediary transferring component, while the toner image is conveyed through the primary transferring section N1 (primary transfer nip) which is the area of contact between the photosensitive drum 1 and intermediary transfer belt 7. In an operation for forming a full-color image, for example, each of the charging, exposing, developing, and primary transferring processes is carried out in each of the first, second, third, and fourth image forming sections S in a similar manner. Consequently, yellow (Y), magenta (M), cyan (C) and black (Bk) toner images are sequentially transferred (primary transfer) in a manner of being layered upon each other on the intermediary transfer belt 7. Consequently, a synthetic color image (multilayer toner image) which corresponds to the intended color image is obtained on the intermediary transfer belt 7.

The toner image on the intermediary transfer belt 7 is conveyed through the secondary transferring section N2 (secondary transfer nip), which is the area of contact between the intermediary transfer belt 7, and the secondary transfer roller 13, as the secondary transferring means. As the toner image is conveyed through the secondary transfer nip N2, it is transferred (secondary transfer) onto a sheet P of recording medium such as recording paper. During the secondary transfer of the toner image, preset secondary transfer voltage is applied to the secondary transfer roller 13 from a secondary transfer power source 53 (high voltage power source) as the secondary transfer voltage applying means. In an operation for forming a full-color image, for example, the multiple toner images layered upon the intermediary transfer belt 7 are transferred together (secondary transfer) onto the sheet P of recording medium, which is supplied to the secondary transfer nip N2 by a transferring medium supply roller (unshown) as a transfer medium supplying means, with the same timing as the toner images on the intermediary transfer belt 7. By the way, the intermediary transfer belt 7, primary transfer process, and secondary transfer process are described later in greater detail.

After the transfer of the toner image(s) onto the sheet P of recording medium, the sheet P is introduced into a fixing device (unshown) as a fixing means, and is conveyed through the fixing device while remaining sandwiched between the fixation roller and pressure roller of the fixing device, which are kept pressed upon each other. While the sheet P is conveyed through the fixing device, it is subjected to heat and pressure. Thus, the toner on the sheet P is welded (melted and solidified) to the sheet P. During the fixing process in an operation for forming a full-color image, for example, the multiple toners, different in color, become mixed as they melt. Then, they become fixed to the sheet P as they cool down. After the fixation of the toner images to the sheet P, the sheet P is discharged (outputted) from the main assembly of the image forming apparatus 100.

By the way, the toner (primary transfer residual toner) remaining on the peripheral surface of the photosensitive drum 1 after the primary transferring process is removed and recovered by the cleaning device 6 as a cleaning means. The toner (secondary transfer residual toner) remaining on the surface of the intermediary transfer belt 7 after the secondary transferring process is removed and recovered by the belt cleaning device 14.

2. Intermediary Transfer Belt

In this embodiment, the intermediary transfer belt 7 has two or more layers. Its surface layer is higher in electrical resistance than other layers. More precisely, the intermediary transfer belt 7 in this embodiment has two layers, which are a substrative layer and a surface layer. As the material for the substrative layer, a mixture of a resinous substance such as polyimide and polyamide, or various rubbers, and a preset (proper) amount of charge inhibition agent such as carbon black, is used. In this embodiment, polyimide was used. The volume resistivity of the substrative layer is adjusted to a value in a range of $10^2$-$10^7$ Ω·cm, typically, a value in a range of $10^5$-$10^8$ Ω·cm. As for the thickness of the substrative layer, it is in a range of 45-150 μm in average thickness. That is, the substrative layer is an endless belt formed of thin film of one of the abovementioned substances. By the way, the material for the substrative layer may be polyphenylsulfide (PPS), PVdF, Nylon, PET, PBT, polycarbonate, PEEK, PEN, or the like. There is provided a coat layer, as a surface layer, on the substrative layer. The coat layer is practically non-conductive. In this embodiment, the surface layer is formed of acrylic, and its volume resistivity is in a range of $10^{13}$-$10^{16}$ Ω·cm. Its thickness is in a range of 1-20 μm. Further, the volume resistivity of the intermediary transfer belt 7, including the surface layer, in terms of its thickness direction, is in a range of $10^{10}$-$10^{13}$ Ω·cm.

The intermediary transfer belt 7 is suspended and kept tensioned by multiple belt supporting components, which are a driver roller 10, a tension roller 11, and a pair of idler rollers 12A and 12B. The intermediary transfer belt 7 is circularly driven (rotated) by the driver roller 10, to which driving force is transmitted, in the direction indicated by an arrow mark R2 in the drawing, at a preset peripheral velocity (process speed). In this embodiment, the process speed is 130 mm/sec. The driver roller 10 doubles as the secondary transfer inner roller, which opposes the secondary transfer roller, with the presence of the intermediary transfer belt 7 between itself and secondary transfer roller 13. It circularly drives the intermediary transfer belt 7 by being driven by a motor which is highly stable in speed. The tension roller 11 provides the intermediary transfer belt 7 with a preset amount of tension, and also, functions as a correction roller for preventing the intermediary transfer belt 7 from snaking. The idler rollers 12A and 12B support the intermediary transfer belt 7, in a range in which the intermediary transfer belt 7 extends in the direction in which the photosensitive drums 1*a*, 1*b*, 1*c* and 1*d* are aligned, in contact with the photosensitive drums 1, causing thereby the intermediary transfer belt 7 to create an image transfer surface. In this embodiment, the amount of the tension with which the intermediary transfer belt 7 is provided by the tension roller 11 is roughly in a range of 5-12 kgf. The four toner images formed on the photosensitive drums 1*a*, 1*b*, 1*c* and 1*d*, one for one, are electrostatically adhered to the intermediary transfer belt 7 in a sequential order, in a manner to be layered upon the intermediary transfer belt 7. Thus, there are four primary transferring sections N1, which are the areas of contact between the tensioned intermediary transfer belt 7 and the four photosensitive drums 1*a*, 1*b*, 1*c* and 1*d*. As for the secondary transferring section N2, it is the area of contact between the outward surface (toner image bearing surface) of the intermediary transfer belt 7, in terms of the loop which the intermediary transfer belt 7 forms, and the secondary transfer roller 13 (secondary transfer outer roller) disposed on the outward side of the belt loop in a manner to oppose the driver roller 10 (secondary transfer inner roller).

The driver roller 10 has a metallic core (core component), and an electrically conductive elastic layer (rubber layer) formed, as a surface layer, of EPDM rubber, on the peripheral surface of the metallic core. The driver roller 10 is 20 mm in external diameter. The thickness of the elastic layer is 0.5 mm. Its hardness is set to 70° (Asker-C), for example. The secondary transfer roller 13 has a metallic core (core component), and an elastic layer formed of NBR rubber, EPDM rubber, or the like, on the peripheral surface of the metallic core. The secondary transfer roller 13 is 24 mm in external diameter. It is in connection to the secondary transfer power source 53.

The voltage applied to the secondary transfer roller 13 from the secondary transfer power source 53 is variable.

The image forming apparatus 100 is provided with a belt cleaning device 14. In terms of the rotational direction of the intermediary transfer belt 7, the belt cleaning device 14 is on the downstream side of the secondary transferring section N2, and on the upstream side of the primary transferring section N1. The belt cleaning device 14 cleans the surface of the intermediary transfer belt 7; it removes the toner remaining on the intermediary transfer belt 7 after the secondary transferring process. In this embodiment, the belt cleaning device 14 is disposed in a manner to oppose the tension roller 11.

3. Method for Adjusting Intermediary Transfer Belt in Surface Potential Level

Next, the method for adjusting the intermediary transfer belt 7 in this embodiment in surface potential level is described.

In this embodiment, all of the belt-supporting-tensioning rollers 10, 11, 12A and 12B by which the intermediary transfer belt 7 is supported are electrically grounded (connected to ground) through resistance elements 15 (15A and 15B). In this embodiment, the driver roller 10 and the idler roller 12B which is in the adjacencies of the driver roller 10, are in connection to the first resistance element 15A. Further, the tension roller 11, and the other idler roller 12A which is in the adjacencies of the tension roller 12, are in connection to the second resistance element 15B.

By the way, in this embodiment, the four belt-supporting-tensioning rollers are divided into two pairs, and each pair is grounded through a single common resistance element. However, all rollers may be grounded through a common resistance element, or some or all of the rollers may be individually grounded through their own resistance element.

The amount of the resistance of the resistance element 15 may be set so that the surface potential level of the intermediary transfer belt 7 remains higher than a preset value set to ensure satisfactory primary transfer. This resistance value is desired to be no less than $10^8$ [Ω]. In a case where a sponge roller or the like is employed as the primary transfer component, the impedance of the primary transferring section is on the order of $10^7$ Ω. Thus, by employing resistance elements which are significantly greater in resistance value than $10^7$ Ω, it is possible to reduce the amount by which electric current flows to the belt-supporting-tensioning rollers. Therefore, it is possible to cause most of electric current to flow to the photosensitive drums 1. Normally, the resistance value may be no greater than $10^9$ Ω. On the other hand, even if the resistance value is reduced to as low as roughly 100 MΩ, the transferring process can be carried out. However, if the resistance value is excessively small, it becomes necessary to increase the electric power source in capacity to compensate for the resistance value. Therefore, the resistance value is desired to be no less than $10^8$ Ω and no more than $10^9$ Ω. In this embodiment, both the resistance value of the resistance element 15A and that of the resistance element 15B were set to $10^8$ Ω.

The image forming apparatus 100 in this embodiment is structured as described above. Therefore, as voltage is applied to the secondary transfer roller 13 by the secondary transfer power source 53, electric current flows into the photosensitive drums 1*a*, 1*b*, 1*c* and 1*d* through the intermediary transfer belt 7. Therefore, each of the four primary transferring sections N1 is subjected to an electric field which is similar to the one which is generated as voltage is applied to each of the primary transferring sections of a conventional image forming apparatus by an electric power source dedicated to primary transfer. Consequently, toner is transferred (primary transfer) from each of the photosensitive drums 1*a*, 1*b*, 1*c* and 1*d* onto the intermediary transfer belt 7. In this embodiment, however, the resistance elements 15 are disposed as described above. Therefore, the surface potential level of the intermediary transfer belt 7 fluctuates in response to the voltage applied to the secondary transfer roller 13. Thus, in order to ensure that the amount of difference in potential level between the photosensitive drum 1 and intermediary transfer belt 7 becomes proper for satisfactory primary transfer, such voltage that is greater in value than a preset one is applied to the secondary transfer roller 13, to keep the surface potential level of the intermediary transfer belt 7 higher than a preset value. That is, in this embodiment, potential is generated in the primary transferring section N1 by causing electric current to flow through the intermediary transfer belt 7 in the circumferential direction of the belt 7 with the use of the secondary transfer power source 53, thereby charging the surface of the intermediary transfer belt 7 to a preset potential level. More precisely, the intermediary transfer belt 7 is positively (oppositely from normal polarity of toner) charged to a preset potential level in the primary transferring section N1. This preset potential level is greater than that of the photosensitive drum 1 in terms of the positive direction (opposite direction from normal polarity to which toner becomes charged). Thus, the negatively charged toner images on the intermediary transfer belt 7 are moved (secondary transfer) onto the sheet P of recording medium by the function of the difference in potential level between the intermediary transfer belt 7 and secondary transfer roller 13, in the secondary transferring section N2.

Further, as preset voltage is applied to the secondary transfer roller 13 from the secondary transfer power source 53, potential is generated in the secondary transferring section N2. More precisely, preset positive (opposite from normal toner charge) potential is generated on the secondary transfer roller 13 in the secondary transferring section N2. This potential is higher than the potential of the intermediary transfer belt 7 in the positive direction (opposite from normal toner charge). Thus, the negative charged toner image on the intermediary transfer belt 7 is made to move (secondary transfer) onto a sheet P of recording medium, by the function of the difference in potential level between the intermediary transfer belt 7 and secondary transfer roller 13, in the secondary transferring section N2.

4. Method for Adjusting Transfer Contrast

Next, the method for adjusting the transfer contrast is described. Part (a) of FIG. 3 is a schematic drawing for showing an example of the relationship between the surface potential level of the photosensitive drum 1 and that of the intermediary transfer belt 7.

In this embodiment, the peripheral surface of the photosensitive drum 1 is uniformly charged by the charge roller 2 to a background potential level Vd (pre-exposure potential level). Here, the pre-exposure potential level Vd is −600 V. As a given point of the uniformly charged peripheral surface of the photosensitive drum 1 is exposed by the exposing device 3, the surface potential level of this point changes to a post-exposure potential level V1. Here, the post-exposure potential level V1 is −150 V. To the development roller, development bias Vdc (DC component in development voltage), relative to the surface potential level of the photosensitive drum 1, is applied. Thus, the negatively charged toner is made to adhere to the exposed points of the peripheral surface of the photosensitive drum 1, by the development contrast Vcont, which is the difference between the development bias Vdc and the post-exposure potential level V1, which is the potential level of the exposed points of the peripheral surface of the photosensitive drum 1. Further, the toner on the unexposed points on the peripheral surface of the photosensitive drum 1 is made to return to the development roller of the developing device 4 by the back contrast Vback, which is the difference between the development bias Vdc and the background potential level Vd, on the peripheral surface of the photosensitive drum 1. Here, the development bias Vdc is −400 V. Thus, the development contrast Vdc is 250 V, and back contrast Vback is 200 V. Further, the surface potential Vitb of the intermediary transfer belt 7 is fixed to a preset value by the fixation of the value of the resistance elements 15 and the output of the secondary transfer power source 53. Therefore, if the surface potential level Vitb of the intermediary transfer belt 7 is set to 300 V, for example, the transfer contrast, which is the difference between the surface potential level Vitb of the intermediary transfer belt 7 and the post-exposure potential level V1 of the photosensitive drum 1, is 450 V.

Referring to part (b) of FIG. 3, in this embodiment, when it is necessary to adjust the transfer contrast, the surface potential level Vitb of the intermediary transfer belt 7 is not adjusted. Instead, the surface potential levels Vd and V1 are changed. However, in a case where the development bias Vdc is changed, the development contrast Vdc and back contrast Vback are kept unchanged, and Vd, Vdc and V1 are offset toward the negative side. For example, an environment table for the transfer contrast is prepared for each image forming section S, and the transfer contrast is switched according to the condition (amount of moisture, in this embodiment) of the environment in which images are formed, in order to determine the optimal transfer contrast for the environment and the color. Further, in a case where repeated usage of the developer in the developing device 4, and/or repeated usage of the intermediary transfer belt 7 makes it necessary to adjust the transfer contrast, for example, it is possible to switch the environment table for the transfer contrast, according to such factor as the cumulative number of the outputted prints, for example, which is correlated to the cumulative amount of developing device usage. With the use of this type of control, it is possible to obtain the optimal transfer contrast even in a case where it is necessary to change the developing device 4 in transfer contrast due to the repeated usage of the developing device 4.

5. Control

Figure 2:
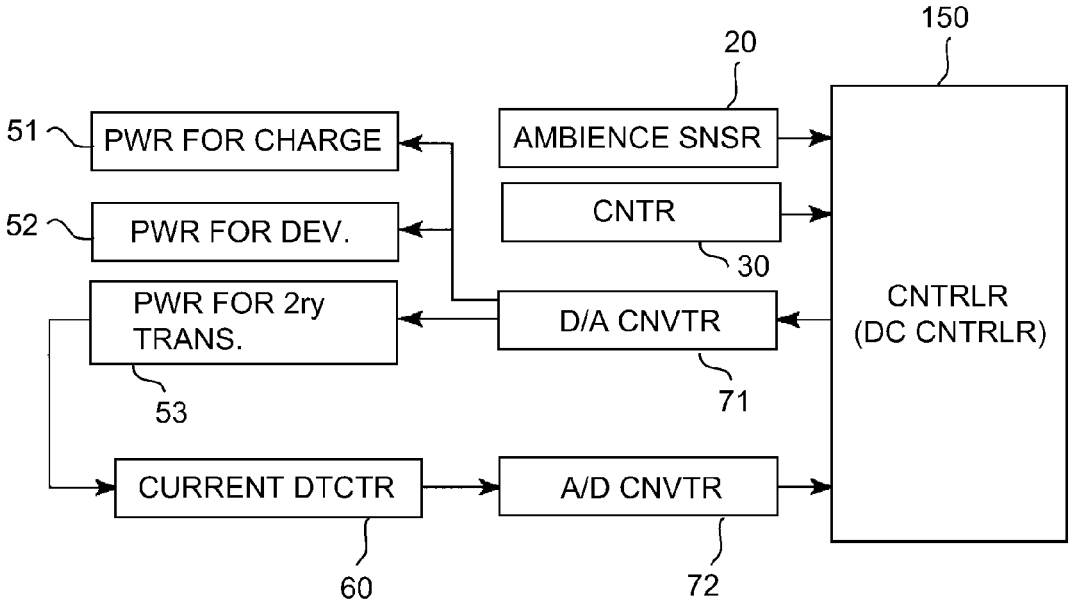
FIG. 2 is a block diagram of the control system of the image forming apparatus shown in FIG. 1, which controls the essential sections of the image forming apparatus.

FIG. 2 is a block diagram of the control sequence for controlling the essential sections of the image forming apparatus 100 in this embodiment. In this embodiment, the image forming apparatus 100 is provided with a controlling section 150 (DC controller) as a controlling means, which controls the overall operation of the image forming apparatus 100. The controlling section 150 is made up of a CPU which is the central element for computation, a ROM and a RAM which are storage elements, etc. The RAM stores the results of the detection by sensors, results of the computation, etc. The ROM stores control programs, data tables obtained in advance, etc. The controlling section 150 is in connection with each of the sections of the image forming apparatus 100, which need to be controlled. In particular, regarding the control in this embodiment, to the controlling section 150, the charge voltage power source 51, development voltage power source 52, secondary transfer power source 53, etc., are in connection. Further, in this embodiment, an environment sensor 20, and a counter 30 which counts the number of the outputted prints, that is, the information correlated to the cumulative usage of the developing device 4, are in connection to the controlling section 150.

Further, in this embodiment, an electric current detection circuit 60, as a current detecting means, is in connection to the controlling section 150 through an A/C converter 72. Also in this embodiment, the current detection circuit 60 is disposed between the secondary transfer power source 53 and secondary transfer roller 13. Thus, the current detection circuit 60 can detect the amount of DC current which flows to the secondary transfer roller 13 as the secondary transfer power source 53 applies DC voltage to the secondary transfer roller 13. In this embodiment, the secondary transfer power source 53 is configured so that it can output such constant voltage that is set by the controlling section 150. Further, the controlling section 150 can cause the secondary transfer power source 53 to apply such voltage that supplies the secondary transfer roller 13 with a preset amount of electric current, by changing the secondary transfer power source 53 in output value so that the current value detected by the current detection circuit 60 remains at a preset value. Further, during this control, the controlling section 150 can obtain the information regarding the voltage value and current value, based on the value to which the output of the secondary transfer power source 53 is set, and the results of the detection by the current detection circuit 60.

In this embodiment, a system which does not have a power source dedicated to primary transfer is employed. Therefore, it is only in the secondary transferring section N2 that the transfer voltage is controlled. In this embodiment, the information regarding the temperature and humidity detected by the environment sensor 20, and the information regarding the number of outputted prints, which is provided by the counter 30 and is correlated to the cumulative amount of usage of the developing device 4, are sent to the controlling section 150, whereby the primary transfer contrast is set. The digital signals outputted from the controlling section 150 are converted into analog signals by the D/A converter 71, and then, are used to cause the secondary transfer power source 53 to output high voltage. Further, the analog signals obtained by detecting the current outputted from the secondary transfer power source 53, with the use of the current detection circuit 60, are converted into digital signals by the A/D converter 72, and are fed back to the controlling section 150. As for the secondary transfer ATVC, it is described later.

The image forming apparatus 100 performs an image forming operation (job) which is started by a start command for forming an image on a single sheet of recording medium, and outputting the sheet (print), or an image forming operation (job) which is started by a start command for forming multiple images on multiple sheets of recording medium, one for one, and outputting the sheets. Generally speaking, a job includes an image formation process (printing process), a pre-rotation process, sheet intervals which occur in an operation for forming images on two or more sheets of recording medium, one for one, and a post-rotation process. The image formation process corresponds to the period in which an electrostatic latent image of an original image to be formed on a sheet P of recording medium and outputted is formed; a toner image is formed; the toner image is transferred for the first time; and the toner image is transferred for the second time. This period is what "image formation period" means. The pre-rotation process corresponds to the period which is between when a start command is inputted and when an image begins to be actually formed. That is, it is a preparatory process carried out prior to the starting of the image formation process. The sheet intervals correspond to periods which occur between two consecutively conveyed sheets P of recording medium in an image forming operation (continuous image forming operation) in which the image formation processes are consecutively carried out for multiple sheets P of recording medium. The post-rotation process corresponds to the period which occurs after the image formation process, and in which the image forming apparatus is examined and adjusted. The no-image-formation periods are periods other than the image formation period. That is, they include the abovementioned pre-rotation period, sheet intervals, post-rotation period, and also, such a pre-rotation process which is carried out to start up the image forming apparatus 100 as the apparatus 100 is started up after it was turned off or put to sleep, and the like processes.

6. ATVC of Secondary Transferring Section

Next, the ATVC of the secondary transferring section N2 (secondary transfer ATVC) is described. The secondary transfer ATVC is roughly such a control as the following one. That is, when no sheet P of recording medium is in the secondary transferring section N2 during the pre-rotation process, for example, voltage is applied to the secondary transfer roller 13 from the secondary transfer power source 53, and the information regarding the voltage value and current value is obtained. Then, based on this information, the target value for the secondary transfer voltage which is to be applied to the secondary transfer roller 13 from the secondary transfer power source 53 during the image formation period is obtained.

More concretely, in the secondary transfer ATVC, the target value for the secondary transfer voltage to be applied during the image formation period is obtained in the following manner. That is, the value of the voltage applied to the secondary transfer roller 13 from the secondary transfer power source 53 in such a manner that the amount of current flowed by the voltage remains stable at a preset value is obtained. Then, the obtained voltage value itself, or a value derived from the obtained voltage value, with the use of a preset computation formula and/or with reference to a lookup table, can be used as the target value for the secondary transfer voltage to be applied during the image formation period. Or, the voltage to be applied to the secondary transfer roller 13 from the secondary transfer power source 53 may be changed in value (multiple values) to obtain the relationship between the voltage value and the value (amount) of the current generated by the applied voltages. Then, based on this relationship, a voltage value which is necessary to flow a desired amount of current is obtained. Then, this voltage value is used as the target value for the secondary transfer voltage to be applied during the image formation period. In this embodiment, the latter method is employed as will be described later in detail.

The secondary transfer ATVC can be used to determine the target value for the secondary transfer voltage to be applied during the pre-rotation process in each job. However, this embodiment is not intended to limit the present invention in scope. For example, it may be for every several jobs that the secondary transfer ATVC is carried out during the pre-rotation process. Further, the process in which the secondary transfer ATVC is to be carried out is not limited to the pre-rotation process. For example, it may be carried out during the sheet intervals, post-rotation process, etc. That is, the timing with which the secondary transfer ATVC is to be carried out is optional, as long as it is not during the image formation process.

At this time, the secondary transfer ATVC which is carried out by a conventional image forming apparatus having both an electric power source dedicated to the primary transfer, and an electric power source dedicated to the secondary transfer, is described. FIG. 4 is a drawing for describing the operation for obtaining a proper value for the secondary transfer voltage from the voltage value and current value obtained with the use of the secondary transfer ATVC. Referring to FIG. 4, in the secondary transfer ATVC, positive voltages V1, V2 and V3 which are different in value are applied, and the currents I1, I2 and I3 which are flowed by the voltages, respectively, are detected. Then, based on the relationship between the voltage values and obtained current values, respectively, the voltage Vtr which is to be applied to flow a specific amount Itr of current is determined. In the case of a conventional image forming apparatus, the secondary transfer voltage is applied to the secondary transfer roller 13 to cause electric current to flow to a grounded component which opposes the secondary transfer roller 13. Thus, the application of the secondary transfer voltage to the secondary transfer roller 13 has no effect upon the primary transferring section N1. Therefore, it may be thought that the secondary transfer ATVC is independent from the primary transferring section N1. Therefore, it is unnecessary to synchronize the application of voltage to the secondary transfer roller 13 with the application of the charge voltage, during the secondary transfer ATVC. In the case of a conventional image forming apparatus, therefore, the charge voltage is not applied during the secondary transfer ATVC. FIG. 5 is a timing chart which shows the timing with which the charge voltage and secondary transfer voltage are applied for the secondary transfer ATVC.

In comparison, in the case of the image forming apparatus 100 in this embodiment, which employs the system which does not have an electric power source dedicated to primary transfer, the surface potential level necessary for the intermediary transfer belt 7, in the primary transferring section N1, is determined by intentionally causing the secondary transfer voltage to interfere with the primary transferring section N1. Therefore, as the secondary transfer voltage is applied, the primary transferring section N1 is subjected to the voltage at the same time as the secondary transferring section N2. If a given area of the peripheral surface of the photosensitive drum 1, which is yet to be charged, is conveyed through the primary transferring section N1 while the primary transferring section N1 is in the above described state, the given area is charged to the opposite polarity from the normal polarity to which the photosensitive drum 1 is to be charged, causing sometimes drum memory.

In this embodiment, therefore, when the controlling section 150 applies the secondary transfer voltage (positive voltage in this embodiment) during the secondary transfer ATVC, it applies charge voltage in synchronism with the application of the secondary transfer voltage to charge (negatively, in this embodiment) the photosensitive drum 1, in order to cause electric current to flow from the secondary transfer roller 13 to the photosensitive drum 1. FIG. 6 is a timing chart which shows the timing with which the charge voltage and secondary transfer voltage are applied for the secondary transfer ATVC carried out by the image forming apparatus 100 in this embodiment.

In this embodiment, the charge voltage applied for the secondary transfer ATVC is a combination of AC component and DC component, like the one applied during the image formation process. Strictly speaking, however, the charge voltage to be applied for the secondary transfer ATVC may be different from the one applied during the image formation process. That is, it is not necessarily required to be able to uniformly charge the photosensitive drum 1. Therefore, the charge voltage to be applied for the secondary transfer ATVC does not need to include AC voltage, which is applied for the uniformity of charge; it may be only DC voltage that is applied. Further, it is not necessarily required to charge the photosensitive drum 1 to the same potential level as the level to which the photosensitive drum 1 is charged for the image formation process. Therefore, the DC voltage to be applied for the secondary transfer ATVC may be smaller in absolute value than the one applied during the image formation process.

Here, "synchronizing the application of the charge voltage with the application of the secondary transfer voltage" means to apply the charge voltage with such a timing that the charge voltage is enabled to charge at least the area of the peripheral surface of the photosensitive drum 1, which will come into contact with the intermediary transfer belt 7 after the intermediary transfer belt 7 is positively charged by the application of the secondary transfer voltage. In this embodiment, the application of the charge voltage is started before the application of the secondary transfer voltage, which is positive (by a length of time it takes for a given point of peripheral surface of photosensitive drum 1 to move from the point at which given point is charged by charge roller 2, to primary transferring section N1). Also in this embodiment, in order to better ensure that a given point of the peripheral surface of the photosensitive drum 1 comes into contact with the positively charged intermediary transfer belt 7, the application of the charging voltage is stopped after the application of the secondary transfer voltage (positive) is stopped (application of secondary transfer voltage (negative), or OFF). By the way, in a case where the fully charged area of the photosensitive drum 1 can reach the primary transferring section N1 during the period between when the secondary transfer voltage begins to be applied and when the intermediary transfer belt 304 becomes fully charged, the starting of the application of the secondary transfer voltage, and the starting of the application of the charge voltage, may be practically simultaneous. Further, in a case where the intermediary transfer belt 7 can be fully discharged while the area of the peripheral surface of the photosensitive drum 1, which is yet to be charged, reaches the primary transferring section N1 after the stopping of the application of the charge voltage, the stopping of the application of the charge voltage and the stopping of the application of the secondary transfer voltage may be practically simultaneous. In FIG. 6, the timing with which the charge voltage is applied, and the timing with which the secondary transfer voltage is applied, are simultaneous.

Next, referring to FIG. 7 (flowchart), the operation carried out for a job by the image forming apparatus 100 in this embodiment is described. The secondary transfer roller 13 sometimes changes in electrical resistance due to its usage. In this embodiment, therefore, in order to apply proper secondary transfer voltage, the secondary transfer ATVC is carried out for every job, during the pre-rotation process, that is, the process which comes immediately prior to the image formation process.

As the controlling section 150 makes the image forming apparatus 100 to start the image forming operation for a given job, it makes the image forming apparatus 100 start the pre-rotation process, which is to be carried out to make the image forming apparatus carry out various controlling sub-processes, for example, sub-process for controlling the photosensitive drum 1 in potential level, sub-process for controlling the image forming apparatus 100 in tone, and the like (S101). Next, the controlling section 150 makes the image forming apparatus 100 to apply the charge voltage in synchronism with the application of the secondary transfer voltage (practically simultaneously, in this embodiment) (S102, S103). Then, the controlling section 150 makes the image forming apparatus 100 carry out the secondary transfer ATVC to determine a proper value for the voltage so that electric current flows by the target amount (S104). Thereafter, the controlling section 150 makes the image forming apparatus 100 form images (S105). As soon as the job is completed, the controlling section 150 makes the image forming apparatus 100 carry out the post-rotation process in which gamma correction, and the like sub-process are carried out, and then, makes the image forming apparatus 100 stop the operation of each of various sections of the apparatus. Then, the control section 150 stops the image forming apparatus 100 (S107).

7. Example of Evaluation Test

Next, the results of the tests carried out to evaluate the secondary transfer ATVC in this embodiment are described.

7-1. Evaluation Test 1

A test was carried out to evaluate the secondary transfer ATVC in which the application of the secondary transfer voltage and the application of the charge voltage are not synchronized. In this test, during the period between when the image forming apparatus 100 was started for a job and when the image formation process was started, the secondary transfer voltage was applied, but the charge voltage was not applied (FIG. 5).

In the secondary transfer ATVC, two secondary transfer voltages which are different in value, for example, 500V and 1,000 V, are applied, and the electric currents flowed by the two secondary transfer voltages are detected by the current detection circuit 60. Then, the amount by which voltage is to be applied by the secondary transfer power source 53 to cause 35.0 μA (target amount) of electric current to flow is determined by linear interpolation between the two points which show the relationship between the amount of the applied voltage and the amount of electric current flowed by the voltage. In this evaluation test, the value obtained (calculated) for the secondary transfer voltage through the secondary transfer ATVC was 900 V. Further, during the period prior to the starting of the image formation process, the charge voltage was not applied. The length of time the secondary transfer voltage was applied (length of secondary transfer ATVC) was roughly 10 seconds.

In this evaluation test, a job for outputting prints which were 5% in print ratio was repeated in a N-N environment (23° C. in temperature and 50% in relative humidity). As a result, image defects (nonuniformity in image density) attributable to drum memory began to occur after roughly the 5,000th print (assuming that recording medium is A4 in size) was outputted.

7-2. Evaluation Test 2

In this evaluation test, the application of the secondary transfer voltage and the application of the charge voltage were synchronized during the secondary transfer ATVC, as in this embodiment. In this case, during the period between the starting of the job and the starting of the image formation process, not only was the secondary transfer voltage applied, but also, the charge voltage was applied in synchronism with the application of the secondary transfer voltage (FIG. 6).

The secondary transfer ATVC was carried out as it was in Evaluation test 1. Also in this evaluation test, the value obtained (calculated) for the secondary transfer voltage through the secondary transfer ATVC was 900 V. Further, in order to carry out the secondary transfer ATVC, the charge voltage also was applied in synchronism (practically, at the same time) with the timing with which the secondary transfer voltage was applied. As for the timing for the application of the charge voltage, since the length of time the secondary transfer ATVC was carried out was roughly 10 seconds, the application of the charge voltage started roughly 10 seconds earlier compared to Evaluation test 1.

Also in this evaluation test, a job for outputting prints which were 5% in print ratio was repeated in a N-N environment (23° C. in temperature and 50% in relative humidity), as in Evaluation test 1. As a result, image defects (nonuniformity) attributable to drum memory did not occur even after roughly the 5,000th print (assuming that recording medium was A4 in size) was outputted. Further, even after the outputting of the 5,000th print, it did not occur during the life span of the photosensitive drum 1 that image defects (nonuniformity) attributable to drum memory occur.

As described above, in this evaluation test in which the secondary transfer ATVC in this embodiment was carried out, the charge voltage was applied in synchronism with the application of the secondary transfer voltage during the period between the starting of the job and the starting of the application of the charge voltage. Thus, it was possible to prevent the occurrence of drum memory. Hence, it was possible to prevent the occurrence of image defects (nonuniformity in image density) attributable to the drum memory. Therefore, it did not occur that the photosensitive drum 1 has to be replaced because of the occurrence of drum memory. In other words, the referential embodiment was able to reduce the electrophotographic image forming apparatus 100 in the cost and downtime associated with the replacement of the photosensitive drum 1, which is attributable to the occurrence of drum memory.

Embodiment 1

Next, one of the preferred embodiments of the present invention is described. The image forming apparatus in this embodiment is the same in structure and operation as the image forming apparatus in the referential embodiment. Therefore, the elements in the image forming apparatus in this embodiment, which are the same as, or similar to, the counterparts in the image forming apparatus in the referential embodiment, are given the same referential codes, and are not described in detail here.

In the referential embodiment of the present invention, the occurrence of drum memory was prevented by applying the charge voltage in synchronism with the application of the secondary transfer voltage. In the case of the referential embodiment, however, the length of time the photosensitive drum 1 is discharged increases. From the standpoint of extending the photosensitive drum 1 in expected life span, the length of time the photosensitive drum 1 is discharged is desired to be as short as possible.

In this embodiment, therefore, a switching means is connected to at least one of the belt-supporting-tensioning rollers 10, 11, 12A and 12B for the intermediary transfer belt 7. This switching means enables at least one of the belt-suspending-tensioning rollers to be selectively connected to the first path which can ground the roller by way of a resistance element, or the second path which directly grounds the roller (directly connected to grounding element). In a case where the secondary transfer voltage needs to be applied during "no-image-formation period" (while no image is formed; during secondary transfer ATVC), at least one of the abovementioned belt-suspending-tensioning rollers, which is in connection to the first path having the resistance element, is switched in connection to the second path having the grounding element (having no resistance element). Thus, the application of the secondary transfer voltage does not affect the primary transferring section N1. Therefore, it is unnecessary to apply the charging voltage in synchronism with the application of the secondary transfer voltage as in the referential embodiment. Thus, this embodiment can extend the photosensitive drum 1 in expected life span.

FIG. 8 includes schematic sectional views (a) and (b) of the image forming apparatus 100 in this embodiment. In this embodiment, the idler roller 12B which is in the adjacencies of the driver roller 10 is enabled to be selectively connected to a resistance element 15C which is $10^8$ Ω in resistance, or a grounding element 17, by a switch 16 as a switching means. Part (a) of FIG. 8 is a schematic sectional view of the image forming apparatus 100 when the idler roller 12B is in connection to the resistance element 15C, and is grounded through the resistance element 15C. Part (b) of FIG. 8 is a schematic sectional view of the image forming apparatus 100 when the idler roller 12B is in connection to the grounding element 17, being thereby directly grounded. By the way, in this embodiment, only the idler roller 12B is enabled to be selectively connected to the resistance element or grounding element, by the switching means. This embodiment, however, is not intended to limit the present invention in scope. For example, the image forming apparatus 100 may be configured so that two or more (all, for example) belt-suspending-tensioning rollers are enabled to be selectively connected to the resistance element or grounding element by the switching means. In such a case, two or more belt-suspending-tensioning rollers may be individually connected to their own switch, or a single common switch. Further, the two or more belt-suspending-tensioning rollers for the intermediary transfer belt 7 may be individually connected to their own resistance element, or connected together to a single common resistance element.

FIG. 9 is a block diagram of the control sequence for controlling the essential sections of the image forming apparatus 100 in this embodiment. FIG. 9 is roughly the same as FIG. 2. However, in this embodiment, the controlling section 150 is in connection to the switch 16, which the image forming apparatus 100 in the referential embodiment does not have.

Next, the operation which is carried out, for a job, by the image forming apparatus 100 in this embodiment is described.

As the controlling section 150 makes the image forming apparatus 100 start the image forming operation for a given job, it makes the image forming apparatus 100 start the pre-rotation process, which is to be carried out for making the image forming apparatus 100 carry out various sub-processes, for example, sub-process for controlling the photosensitive drum 1 in potential level, sub-process for controlling the image forming apparatus 100 in tone, and the like (S201). Next, the controlling section 150 determines whether it is the time for the secondary transfer ATVC or not (S202). In this embodiment, the secondary transfer ATVC is not carried out for every job. Instead, it is carried out right after the image forming apparatus 100 is turned on, five minutes after the image forming apparatus 100 is turned on, 10 minutes after the image forming apparatus 100 is turned on, and then, every 30 minutes thereafter. As the controlling section 150 determines that it is the time for the secondary transfer ATVC, it turns the switch 17 toward the grounding side (S203), and makes the image forming apparatus 100 carry out the secondary transfer ATVC (S204). This turning of the switch 17 toward the grounding side is done practically at the same time as, or prior to, the starting of the application of the secondary transfer voltage in the secondary transfer ATVC. With the turning of the switch 17 toward the grounding side, the electric current path in the secondary transfer ATVC becomes as indicated by a bold arrow mark in part (b) of FIG. 11. That is, the electric current flows from the secondary transfer roller 13 to the ground through the idler roller 12B. This electric current path is different from the electric current path, indicated by a bold arrow mark in part (a) of FIG. 11, through which electric current flows during the normal image forming operation. In the secondary transfer ATVC in this embodiment, therefore, an accurate (proper) secondary transfer voltage is set with the use of a correction (adjustment) table (Table 1), as a correcting (adjusting) means, with which the controlling section 150 is provided in advance, in consideration of the difference in impedance between the electric current path shown in part (a) of FIG. 11 and that in part (b) of FIG. 11. The concrete correcting (adjusting) method is described later.

Next, after the completion of the secondary transfer ATVC, the controlling section 150 turns the switch 17 back to the resistance element side (S205). This turning of the switch 17 is done with practically the same timing as, or after, the timing with which the application of the secondary transfer voltage is stopped in the secondary transfer ATVC. Thereafter, the controlling section 150 makes the image forming apparatus 100 form images (S206). As soon as the job is completed (207), the controlling section 150 makes the image forming apparatus 100 carry out the post-rotation process in which gamma correction, and the like sub-process are carried out. Then, the controlling section 150 makes the image forming apparatus 100 stop the operation of each of various sections of the apparatus. Then, the control section 150 stops the image forming apparatus 100 (S208).

Next, the results of the evaluation of the effect of the secondary transfer ATVC in this embodiment are described. FIG. 12 is a timing chart which shows the timing with which the switch 17 is changed in position, and the timing with which the charge voltage and secondary transfer voltage were applied.

In the case of the secondary transfer ATVC in this embodiment, 500 V and 700 V were applied as the fixed voltages for the secondary transfer ATVC, and the electric currents which flowed during the application of two voltages were detected by the current detection circuit 60. Then, the amount by which voltage is to be applied by the secondary transfer power source 53 to cause 35.0 μA (target amount) of electric current to flow was determined by linear interpolation between the two points which show the relationship between the amount of the applied voltage and the amount of electric current flowed by the voltage. Further, the difference ΔI between the detected two currents was calculated with the use of the following mathematic expression: difference ΔI=(amount of current detected while 700 V was applied)−(amount of current detected while 500 V was applied).

In this evaluation test, the secondary transfer voltage value obtained (calculated) by the secondary transfer ATVC was 600 V, and ΔI was 10 μA. In this case, 100 V is added to the voltage value obtained by calculation, based on the correction (adjustment) table (Table 1) prepared in advance. Therefore, the final value of the voltage applied to the secondary transferring section N2 during the image formation period was 700 V.

TABLE 1

| ΔI (μA) | Correction voltage |
|---|---|
| 5 | 50 |
| 10 | 100 |
| 15 | 150 |
| 20 | 200 |

Interpolation is used between the given ΔIs.

In this evaluation test, a job for outputting images which are 5% in print ratio was repeated in an N-N environment (23° C. in temperature and 50% in relative humidity). As a result, image defects (nonuniformity in image density) attributable to drum memory did not occur during the life span of the photosensitive drum 1.

As described above, the image forming apparatus 100 in this embodiment has: multiple rotatable photosensitive drums 1 which bear a toner image; and multiple charging means which charge the multiple photosensitive drums 1, one for one, to the first polarity. Further, the image forming apparatus 100 has the intermediary transfer belt 7 for transferring (secondary transfer) the toner images transferred (primary transfer) onto the intermediary transfer belt 7 from the photosensitive drums 1, onto a sheet P of recording medium. The intermediary transfer belt 7 is suspended and kept tensioned by the multiple supporting components 10, 11, 12A and 12B, being enabled to be circularly moved in contact with each of the photosensitive drums 1. Further, the image forming apparatus 100 has the transferring component 13 which contacts the intermediary transfer belt 7, and the power source 53 which applies voltage to the transferring component 13 to transfer the toner images from the intermediary transfer belt 7 onto the sheet P. The abovementioned multiple supporting members are grounded through resistance element(s). As voltage which has the second polarity, which is opposite from the abovementioned first polarity, is applied to the transferring component 13 from the power source 53, the surface potential of the intermediary transfer belt 7 is changed to the second polarity, which is opposite from the first polarity. Thus, electric current flows from the transferring component to the photosensitive drums 1 through the intermediary transfer belt 7. Consequently, the toner images are transferred onto the intermediary transfer belt 7 from the photosensitive drums 1. Moreover, this image forming apparatus 100 has the controlling section 150 which makes the image forming apparatus 100 carry out the adjustment operation in which at least the abovementioned voltage having the second polarity is applied to the transferring component 13 from the power source 53, during the no-image formation period (while no image is formed), that is, while the primary transfer process and secondary transfer process are not carried out. Further, the image forming apparatus 100 has the switching means 16 for grounding at least one of the abovementioned multiple supporting components through resistance element(s), or directly (without presence of resistance element(s)) grounding at least one of the multiple supporting components. In the adjustment operation, when the voltage having the abovementioned second polarity is applied to the transferring component 13 from the power source 53, the controlling section 150 keeps at least one of the abovementioned multiple supporting components directly (without involving resistance element(s)) grounded with the use of the switching means 16.

In this embodiment, the adjustment (correction) operation is the secondary transfer ATVC which applies the voltage having the abovementioned second polarity, to the transferring component 13 from the power source 53; obtains the relationship between the value of the applied voltage and the value of the current flowed by the applied voltage; and determines the proper value for the voltage to be applied to the transferring component 13 from the power source 53 during the second transfer, based on the obtained relationship between the value of the applied voltage and the value of the current flowed by the applied voltage. Further, the image forming apparatus 100 has the adjusting (correcting) means which is for adjusting the voltage value which corresponds to the preset current value, or the current value which corresponds to the preset voltage, in the above described relationship obtained while at least one of the multiple belt-suspending-tensioning rollers is directly grounded, that is, grounded without presence of resistance element. This adjusting means has only to be such a means that is capable of turning (adjusting) the obtained relationship, described above, into the voltage value which corresponds to the preset current value, or the current value which corresponds to the preset voltage value, obtained while the multiple belt-suspending-tensioning rollers for the intermediary transfer belt 7 are grounded through the resistance element(s). In this embodiment, the controlling section 150 is provided in advance with the information (adjustment table: Table 1), as the adjusting means, which shows the relationship between the difference ΔI between the two current values obtained when two voltages different in value are applied to the secondary transferring component, in the secondary transfer ATVC, and the adjustment voltages to be added to the secondary transfer voltage obtained by calculation in the secondary transfer ATVC. The adjustment table (Table 1) can be obtained by finding the relationship between the difference (adjustment (correction) voltage) between the secondary transfer voltage detected by the secondary transfer ATVC when the switch 16 is in connection to the grounding element and that when the switch is in connection to the resistance element, and ΔI, under various conditions. In a case where the secondary transfer ATVC is carried out with the switch 16 being connected to the resistance element(s), the photosensitive drums 1 are charged in the same manner as in the referential embodiment.

As described above, in this embodiment, in a case where it is necessary to apply secondary transfer voltage during the period (during secondary transfer ATVC) between the starting of a job and the starting of the actual image forming process, at least one of the multiple belt-supporting-tensioning rollers for the intermediary transfer belt 7 is directly grounded. Thus, even if the secondary transfer voltage is applied, it does not affect the primary transferring section. Therefore, it is unnecessary to apply the charge voltage in synchronism with the application of the secondary transfer voltage. Therefore, it is possible to prevent the occurrence of the image defects (nonuniformity in image density) attributable to drum memory. Therefore, not only is it possible to extend the photosensitive drums 1 in life span, but also, to reduce an electrostatic image forming apparatus in cost and downtime associated with such a situation that the photosensitive drum(s) 1 has to be replaced because of the occurrence of the drum memory.

[Miscellanies]

In the foregoing, the present invention was described with reference to preferred embodiments of the present invention. However, the preceding embodiments are not intended to limit the present invention in scope.

In the cases of the preceding embodiments described above, the adjustment operation in which the secondary transfer voltage is applied while no image is formed was the secondary transfer ATVC. These embodiments, however, are not intended to limit the present invention. For example, the present invention is also applicable to any operation which requires voltage, which is opposite in polarity from the normal polarity to which the photosensitive drum is to be charged, to be applied to the secondary transfer roller while no image is formed. The effects of such an application are the same as those described above. For example, it may be the operation for cleaning the secondary transfer roller, which has at least a period in which voltage which is opposite in polarity to the charge voltage to be applied to the photosensitive drum is applied to the secondary transfer roller. In the case of a cleaning operation such as the operation for cleaning the secondary transfer roller, it occurs sometimes that voltage, which is opposite in polarity to the voltage to be applied to charge the photosensitive drum, and voltage, which is the same in polarity as the voltage to be applied to charge the photosensitive drum, are alternately applied to the secondary transfer roller. In a case where the control which is similar to that in the referential embodiment is carried out, when voltage which is the same in polarity as the voltage applied to charge the photosensitive drum is applied to the secondary transfer roller, it is unnecessary to apply charge voltage in synchronism with the application of the secondary transfer voltage. In such a case, all that is necessary is for the application of the charge voltage to be stopped in synchronism with the application of the voltage, which is the same in polarity as the voltage applied to charge the photosensitive drum, to the secondary transfer roller. Further, in a case where the control which is similar to that in the first embodiment is carried out, all that is necessary is to directly ground at least one of the multiple belt-suspending-tensioning rollers for the secondary transfer roller when voltage, which is opposite in polarity from the charge given to the photosensitive drum, is applied during the operation for cleaning the secondary transfer roller. Instead, at least one of the multiple belt-suspending-tensioning rollers for the intermediary transfer belt may be kept grounded throughout the period in which voltage is applied to the secondary transfer roller, while the secondary transfer roller is cleaned.

Further, in the preceding embodiments described above, the secondary transferring component was in the form of a roller. However, the preceding embodiments are not intended to limit the present invention is scope. For example, the secondary transferring component may be in the form of a stationary brush, a sheet, a pad, or the like.

Further, in the preceding embodiments, the photosensitive component was in the form of a drum. However, the preceding embodiments are not intended to limit the present invention in terms of the shape of the photosensitive component. For example, the photosensitive component may be in the form of an endless belt.

Further, in the embodiments described above, all the belt-suspending-tensioning rollers were grounded by way of a resistance element (resistance elements). However, a constant-voltage element such as a Zener diode and a varistor may be employed in place of the resistance element. For example, in a case were all the belt-suspending-tensioning rollers are grounded by way of a Zener diode (or Zener diodes, one for one), the potential of the intermediary transfer belt can be kept at a desired Zener voltage (breakdown voltage), by the application of such voltage that is greater in magnitude than a preset value, to the secondary transfer roller. Further, as the voltage is applied to the secondary transfer roller, electric current flows into the photosensitive drum 1 in each image forming section through the intermediary transfer belt, causing thereby the secondary transferring section to function like the conventional primary transferring section.

Moreover, in the embodiments described above, the transfer voltage was kept constant in magnitude, and the value therefor, which causes electric current to flow by a desired amount, was obtained while no image is formed. However, the preceding embodiments are not intended to limit the present invention in scope. For example, in a case where the transfer voltage is controlled so that the amount by which electric current is made to flow by the transfer voltage remains stable at a desired value, the voltage which can generate electric current by a desired amount may be obtained during one of the periods in an image forming operation, in which no image is formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-225644 filed on Nov. 5, 2014, which is hereby incorporated by reference herein in its entirety.

What is claimed is:

1. An image forming apparatus comprising:

a photosensitive member configured to carry a toner image;

a charging member configured to charge said photosensitive member to a first polarity;

an intermediary transfer belt configured to carry the toner image transferred from said photosensitive member at a primary transfer position;

a transfer member provided so as to be contactable to an outer peripheral surface of said intermediary transfer belt and configured to transfer the toner image from said intermediary transfer belt onto a recording material at a secondary-transfer position;

a constant voltage element electrically connected between said intermediary transfer belt and a ground potential and configured to maintain a predetermined voltage when a current flows therethrough;

a switching portion for selectively providing a first state in which said intermediary transfer belt is grounded through said constant voltage element and a second state in which said intermediary transfer belt is grounded not through said constant voltage element;

a voltage source configured to apply a current to said constant voltage element by applying a voltage of a second polarity opposite the first polarity to said transfer member to form a secondary-transfer electric field in the secondary-transfer position and a primary transfer electric field in the primary transfer position; and a controller configured to execute an adjusting operation for applying at least the voltage of the second polarity to said transfer member from said voltage source when neither the primary-transfer nor the secondary-transfer is carried out, wherein said controller provides the second state using said switching portion in a non-image formation period in which the voltage of the second polarity is applied to said transfer member.

2. An apparatus according to claim 1, wherein the adjusting operation determines a voltage applied to said transfer member from said voltage source in the secondary-transfer, from a relation between a voltage and a current when a voltage of the second polarity is applied to said transfer member from said voltage source.

3. An apparatus according to claim 2, wherein said controller corrects a voltage corresponding to a predetermined current or a current corresponding to a predetermined voltage in the relation acquired in the second state to a voltage corresponding to the predetermined current or the current corresponding to the predetermined voltage in the relation acquired in the first state.

4. An apparatus according to claim 1, wherein said intermediary transfer belt has a multi-layer structure, and a surface layer has an electric resistance higher than another layer.

5. An apparatus according to claim 1, wherein said constant voltage element includes a Zener diode.

* * * * *